US005289236A

United States Patent [19]

Yoshino

[11] Patent Number: 5,289,236

[45] Date of Patent: Feb. 22, 1994

[54] IMAGE FORMING APPARATUS

[75] Inventor: Tsutomu Yoshino, Kanagwa, Japan

[73] Assignee: Kabushiki Kaisha Toshiba, Kawasaki, Japan

[21] Appl. No.: 28,401

[22] Filed: Mar. 9, 1993

[30] Foreign Application Priority Data

Mar. 24, 1992 [JP] Japan ..... 4-065776
Oct. 9, 1992 [JP] Japan ..... 4-270650

[51] Int. Cl.[5] ..... G03G 15/04

[52] U.S. Cl. ..... 355/243; 271/9; 355/210; 355/309; 358/300

[58] Field of Search ..... 355/308, 309, 243, 200, 355/202, 210, 204; 271/9; 358/498, 300

[56] References Cited

U.S. PATENT DOCUMENTS

| | | | |
|---|---|---|---|
| 4,426,149 | 1/1984 | Kuemmel et al. | 355/243 X |
| 4,598,994 | 7/1986 | Tomosada et al. | 355/200 |
| 4,768,058 | 8/1988 | Kowalski | 355/243 |
| 4,959,731 | 9/1990 | Fukae | 358/300 |
| 5,150,224 | 9/1992 | Mizude et al. | 355/243 X |
| 5,150,890 | 9/1992 | Kunikawa et al. | 271/9 |
| 5,168,316 | 12/1992 | Hino et al. | 355/309 |
| 5,195,734 | 3/1993 | Tanabe | 271/9 |

FOREIGN PATENT DOCUMENTS

| | | | |
|---|---|---|---|
| 50-62438 | 6/1975 | Japan | G03G 15/00 |
| 59-5489 | 7/1975 | Japan | G65H 3/44 |

*Primary Examiner*—A. T. Grimley
*Assistant Examiner*—Sandra L. Brasé
*Attorney, Agent, or Firm*—Limbach & Limbach

[57] ABSTRACT

Image forming apparatus having an image forming unit for forming an image based on image information on a paper, a magnifying/reducing unit for magnifying/reducing the image to be formed by the image forming unit, multiple paper supplying cassettes for storing papers in different size and supplying the paper to the image forming units, a setting unit for setting times of image forming operation, a selector for selecting one of the multiple paper supplying cassettes and a controller which, in a case when papers of a first size, stored in a first paper supplying cassette, are exhausted before a completion of the times of the image forming operation set by the setting unit, for controlling the selecting unit to select a second paper supplying cassette which stores papers of a second size, and for controlling the magnifying/reducing unit to magnify/reduce the image in accordance with a proportion of the first size and the second size, and for controlling the image forming unit to form an image, magnified/reduced by the magnifying/reducing unit, on the paper of the second size.

11 Claims, 8 Drawing Sheets

IMAGE FORMING APPARATUS

FIELD OF THE INVENTION

The present invention relates to an image forming apparatus, and more particularly to an image forming apparatus for application to electrostatic copying machines or printers, which are provided with a paper storage storing various sized papers to be selectably supplied.

BACKGROUND OF THE INVENTION

Conventionally, when performing an image forming operation on an electronic copying machine, etc., an operator must initially select a paper supply cassette storing papers in desired size among multiple paper supply units through operations of the switches provided on a control panel. The operator then inputs the desired number of copies of an image into an image forming apparatus through ten keys on the control panel. Following the operations, the operator turns ON a copying button or a print key. This causes the image forming apparatus to be supplied papers from the selected paper supply cassette and an original document image to be formed on the papers. This operation is successively repeated for the desired number of papers that is input through the ten keys.

On such an electronic copying machine, etc. there may be a case where papers in the selected paper supply cassette are completely exhausted before completing the copying operation for the desired number of papers that is input through the ten keys. In such a case, if another paper supply cassette storing the same size papers is available, it is possible to succeed the image forming operation and complete the copying of the image for the desired number of papers by switching to the paper supply from that paper supply cassette. However, if no paper supply cassette storing the same size papers is available, there was such a problem that a message "PLEASE FEED PAPER" is displayed, the successive image forming operation was stopped and the desired number of papers with the image formed could not be obtained as the subsequent image forming operation was not carried out.

Therefore, on a complex image forming apparatus with a facsimile unit added to an electronic copying machine for receiving image data composed of digital signals transmitted through data communication, there was such a problem that if fixed size papers were exhausted during the night time data communication, etc., it became impossible to receive data due to the exhaustion of papers provided for the image forming operation.

As described above, there was such a problem that if papers in the paper supply cassette were exhausted and no other paper supply cassette storing the same size papers were available during the successive image forming operation, the operation couldn't be successively carried out but was stopped once and it became necessary, after feeding papers in desired size, to set successive image forming conditions and resume the image forming operation and also, on an apparatus with data communication function provided, the function was stopped.

SUMMARY OF THE INVENTION

It is, therefore, an object of the present invention is to provide an image forming apparatus which is capable of performing the image forming operation on the desired number of papers without stopping the successive image forming operation even if fixed size papers are exhausted in a paper supply cassette during the successive image forming operation.

In order to achieve the above object, an image forming apparatus according to the present invention includes an image forming unit for forming an image based on image information on a paper, a magnifying/reducing unit for magnifying/reducing the image to be formed by the image forming unit, multiple paper supplying cassettes for storing papers in different size and supplying the paper to the image forming units, a setting unit for setting times of image forming operation, a selector for selecting one of the multiple paper supplying cassettes and a controller which, in a case when papers of a first size, stored in a first paper supplying cassette, are exhausted before a completion of the times of the image forming operation set by the setting unit, for controlling the selecting unit to select a second paper supplying cassette which stores papers of a second size, and for controlling the magnifying/reducing unit to magnify/reduce the image in accordance with a proportion of the first size and the second size, and for controlling the image forming unit to form an image, magnified/reduced by the magnifying/reducing unit, on the paper of the second size.

An image forming apparatus according to another aspect of the present invention includes an image forming unit for forming an image based on an image information data on a paper, a communication unit for communicating the image forming information data through a communication line, a processing unit for processing the image information data so as to magnify/reduce the image to be formed by the image forming unit, multiple paper supplying cassettes for storing papers in different size and supplying the paper to the image forming unit, a selector for selecting one of the multiple paper supplying cassettes and a controller which, in a case when papers of a first size, stored in a first paper supplying cassette, are exhausted before a completion of the data communication operation by the communication unit, for controlling the selector to select a second paper supplying cassette which stores papers of a second size, and for controlling the processing unit to process the image information data to magnify/reduce the image in accordance with a proportion of the first size and the second size, and for controlling the image forming unit to form an image, magnified/reduced by the magnifying/reducing unit, on the paper of the second size.

An image forming apparatus according to still another aspect of the present invention includes an image forming unit for forming an image based on image information on a paper, a magnifying/reducing unit for magnifying/reducing the image the image to be formed by the image forming unit, a storage unit for storing a kind of magnifying/reducing ratio, multiple paper supplying cassettes for storing papers in different size and supplying the paper to the image forming unit, a setting unit for setting times of image forming operation, a selector for selecting one of the multiple paper supplying cassettes and a controller which, in a case when papers of a first size, stored in a first paper supplying cassette, are exhausted before a completion of the times of the image forming operation set by the setting unit, for controlling the selector to select a second paper supplying cassette which stores papers of a second size possible for forming an image magnified/reduced by the magnifying/reducing unit in a predetermined ratio stored in the storage, and for controlling the magnifying/reducing unit to magnify/reduce the image in accordance with the predetermined ratio, and for controlling the image forming unit to form an image, magnified/reduced by the magnifying/reducing unit, on the paper of the second size.

An image forming apparatus according to still another aspect of the present invention includes an image forming unit for forming an image based on an image information data on a paper, a communication unit for communicating the image forming information data through a communication line, a processing unit for processing the image information data so as to magnify/reduce the image to be formed by the image forming unit, multiple paper supplying cassettes for storing papers in different size and supplying the paper to the image forming unit, a selector for selecting one of the multiple paper supplying cassettes, and a controller, in a case when papers of a first size, stored in a first paper supplying cassette, are exhausted before a completion of the data communication operation by the communicating unit, for controlling the selector to select a second paper supplying cassette which stores papers of a second size possible, could be formed on the image magnified/reduced by the magnifying/reducing unit in a predetermined ratio stored in the storage, and for controlling the magnifying/reducing unit to magnify/reduce the image in accordance with the predetermined ratio, and for controlling the image forming unit to form an image, magnified/reduced by the magnifying/reducing unit, on the paper of the second size.

Additional objects and advantages of the present invention will be apparent to persons skilled in the art from a study of the following description and the accompanying drawings, which are hereby incorporated in and constitute a part of this specification.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
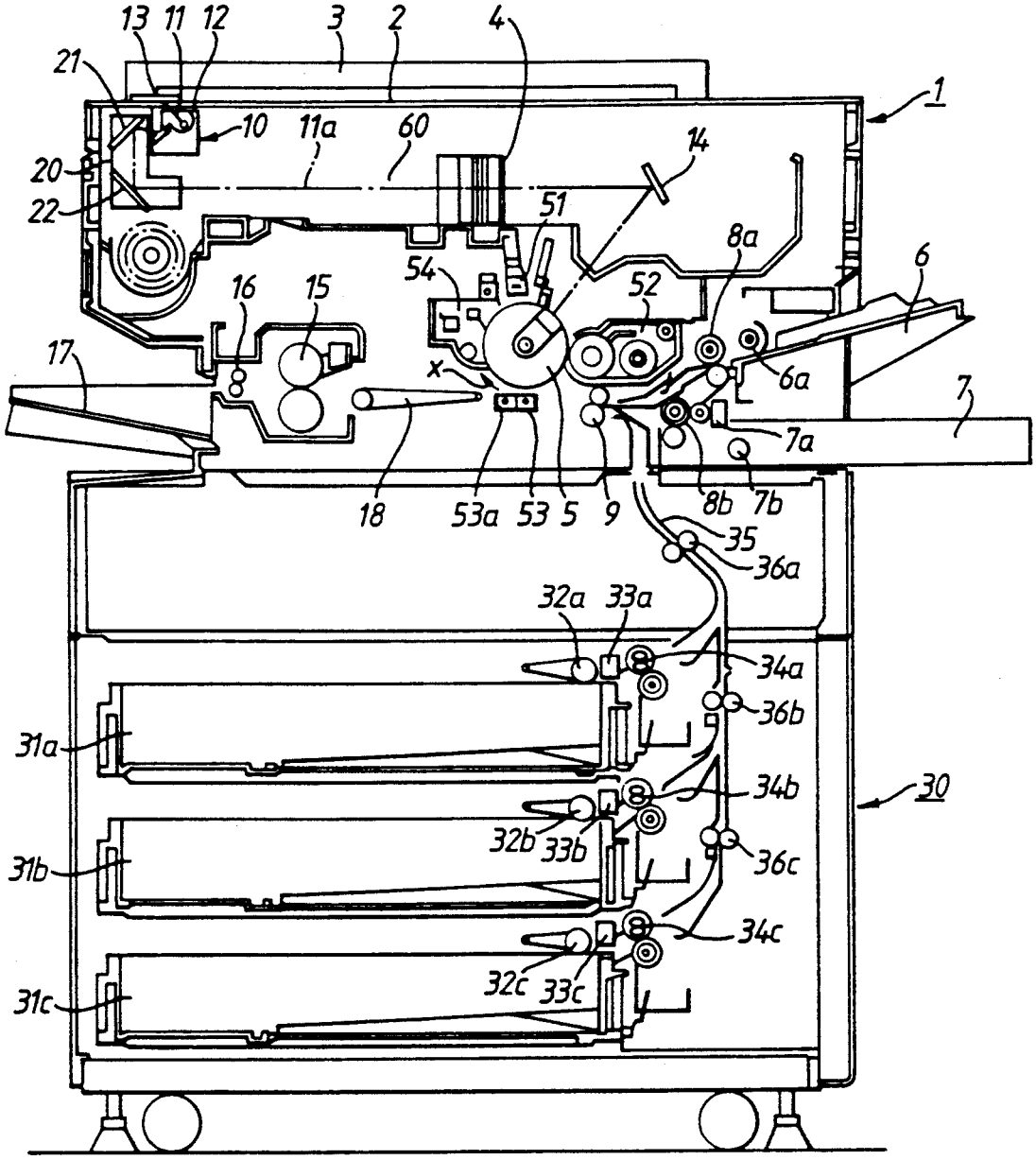
FIG. 1 is a schematic cross-sectional view showing a copying machine of the first embodiment according to the present invention.

The present invention will be described in detail with reference to the FIGURES I through 7. Throughout the drawings, like or equivalent reference numerals or letters will be used to designate like or equivalent elements for simplicity of explanation.

Referring now to FIGS. 1 through 4, a first embodiment of the image forming apparatus according to the present invention will be described in detail.

FIG. 1 is a schematic cross-sectional view of a copying machine 1, which is the image forming apparatus according to the present invention. The copying machine I has on its top a platen glass 2, which is an original table on which an original document D, that is an image data, is placed and a platen cover 3 which can be opened and closed against the platen glass 2. In addition, a control panel, which will be described later, is provided near the platen glass 2.

In the inside of the main body of the copying machine 1 there are a first carriage 10 that has an exposure lamp 11 of an optical scanner device 60 which scans the original document D places on the platen glass 2, a reflecting plate 12 which focuses the light generated from the exposure lamp 11 on the original document D and a first mirror 13 which reflects a reflected light 11*a* from the original document D and a second carriage 20 that has a second mirror 21 and a third mirror 22 for further reflecting the reflected light from the original document D, which is reflected by the first carriage 10. Here, the first carriage 10 is arranged in a movable manner in parallel with the platen glass 2 by a pulse motor (not shown) via a toothed belt (not shown). Further, the second carriage 20 follows the first carriage 10 via the toothed belt (not shown) that drives the first carriage and also moves to the first carriage 10 at a ½ speed.

Within the surface below the first carriage 10 storing the optical axis of the reflected light that is returned via the second carriage 20, a lens 4 is provided in a movable manner via a driving unit (not shown) to apply the focusing property to the reflected light from the second carriage 20 and to focus the reflected light for forming an image at a desired magnification by moving itself by a mirror motor 73*a*. Further, in order to return and focus the reflected light on a desired point on a photosensitive drum 5 for forming an image and at the same time, to correct fluctuation of the focal distance resulting from the movement of the lens 4, a fourth mirror 14 is provided in a movable manner along the optical axis by the driving unit (not shown).

Nearly at the center of the copying machine I and below the lens 4, the photosensitive drum 5 is provided, on which an electric charge distribution pattern (electrostatic latent image) is formed when the reflected light from the original document D led by the fourth mirror 14. The photosensitive drum 5 is rotated in the direction of arrow X by the driving unit (not shown). The photosensitive drum 5 is provided in its surroundings with a main charger 51, a developing device 52 which develops the electrostatic latent image formed on the photosensitive drum 5 by supplying a toner, a transfer charger 53 which transfers the toner image formed on the photosensitive drum 5 on paper P supplied from the paper supply unit which will be described later, and a cleaning device 54 which restores charging characteristic of the photosensitive drum 5 to the initial state by removing electric charge distributed on the photosensitive drum 5 and scrapes off toner remained on the photosensitive drum 5 in order, by which an image forming unit 71 is composed together with the optical scanner device 60. Here, the transfer charger 53 has a separation charger 53*a* for separating the paper P with an image transferred from the photosensitive drum 5 by applying AC voltage.

On the right side of the copying machine 1, that is, on the portion located at the uppermost stream in the paper conveying direction to the transfer position of the photosensitive drum 5, a manual paper supply tray 6 and a paper supply cassette 7 are provided. Further, there are a first and second pick-up rollers 6*a* and 7*b* and first and second paper supply roller pair 8*a* and 8*b* for supplying the paper P to an aligning rollers 9 which will be described later from the manual paper supply tray 6 and the paper supply cassette 7. In the down stream of these first and second paper supply rollers 8*a* and 8*b*, the aligning rollers 9 are provided to align the conveyed paper P and further convey it to the transfer position. In the vicinity of the paper supply cassette 7, a paper empty sensor 7*a* which is composed of, for instance a light reflection type sensor is provided to detect availability of papers in the paper supply cassette 7.

On the left side of the copying machine 1, that is, on the portion located at the down stream in the paper conveying direction to the transfer position of the photosensitive drum 5, a conveyer belt 18 is provided to convey the paper P with the toner image transferred from the photosensitive drum 5. At the downstream of the conveyer belt 18, a fixing device 15 is provided to fix a toner image transferred on the paper P. At the further downstream of the fixing device 15, exit roller pair 16 are provided to eject the paper P with an image fixed to a receiving ray 17 outside the main body of the copying machine 1.

Below the copying machine 1, there is a multi-stage paper feeding pedestal (hereinafter referred to as PEP) 30 which, formed separately from the copying machine 1, serves as a pedestal for installing the copying machine 1 and houses first through third paper supply cassettes 31*a*, 31*b* and 31*c*. These first through third paper supply cassettes 31*a*, 31*b* and 31*c* are provided with first through third pick-up rollers 32*a*, 32*b* and 32*c* for taking out paper P and first through third paper supply rollers 34*a*, 24*b* and 34*c*, for respectively feeding paper P to paper conveyor rollers of a paper conveyor path 35, which will be described later. The PFP 30 is provided with the paper conveyor path 35 which feeds papers to the side of the aligning rollers 9 of the copying machine 1. The paper conveyor path 35 is shown by a chain line in FIG. 1. Along the paper conveyor path 35, first through third conveyor rollers 36*a*, 36*b* and 36*c* are provided. Of these rollers, the first conveyor roller 36*a* is used for supplying papers from any paper supply cassettes, the second conveyor roller 36*b* is used for supplying papers from only the second paper supply cassette 31*b* and the third paper supply cassette 31*c*, and the third conveyor roller 36*c* is used for supplying papers from only the third paper supply cassette. Further, the paper supply cassettes 31*a*, 31*b* and 31*c* are equipped with paper empty sensors 33*a*, 33*b* and 33*c* consisting of, for instance a light reflecting type sensor, for respectively detecting empty of paper in the respective paper supply cassettes.

Figure 2:
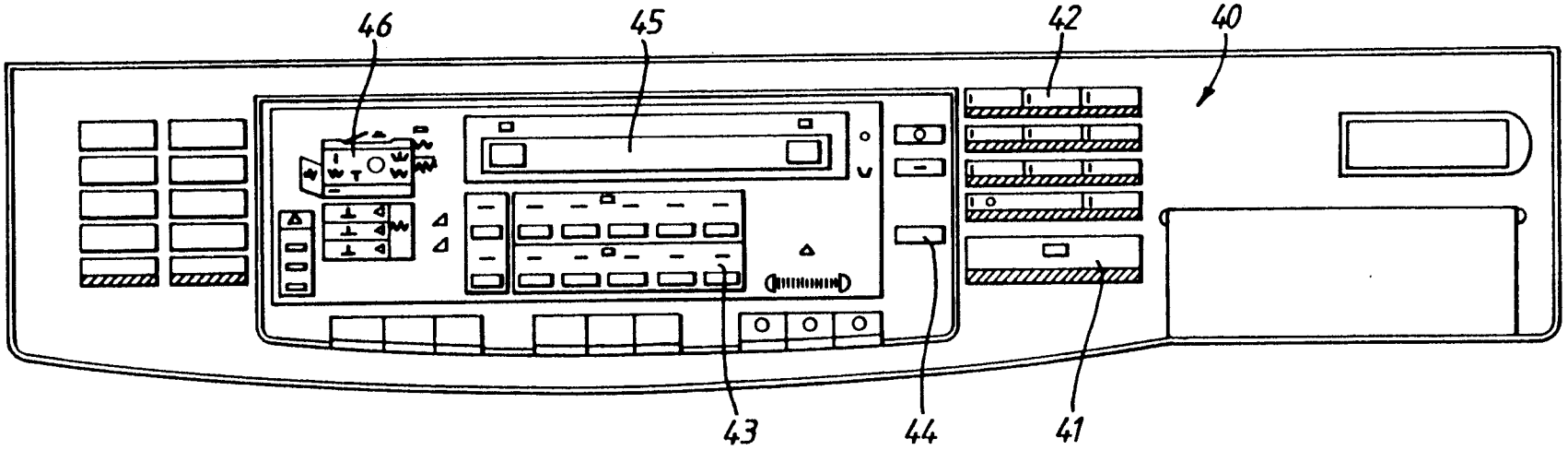
FIG. 2 is a flat view showing the control panel of the copying mac e of the first embodiment according to the present invention.

FIG. 2 shows a control panel 40 provided on the top of the copying machine 1. On the control panel 40, various input means are provided such as a print key 41 for indicating start of copying operation, ten keys 42 for setting image forming conditions such as the number of papers to be copied, copying magnification, etc., a paper size selection key 43 for selecting paper size, a mode selection key 44 which is means for indicating selection of the successive paper supply mode and the normal paper supply mode, etc. In addition, a liquid crystal display (hereinafter referred to as LCD) 45 for displaying such data and error messages as the number of required copies, copying magnification, etc. operating instructions and a monitor light emitting diodes display (hereinafter referred to as LED display) 46 for displaying the operating status of the copying machine, for instance, a selected paper supply cassette, a location where a paper jam occurred, etc. are also provided on the control panel 40.

Figure 3:
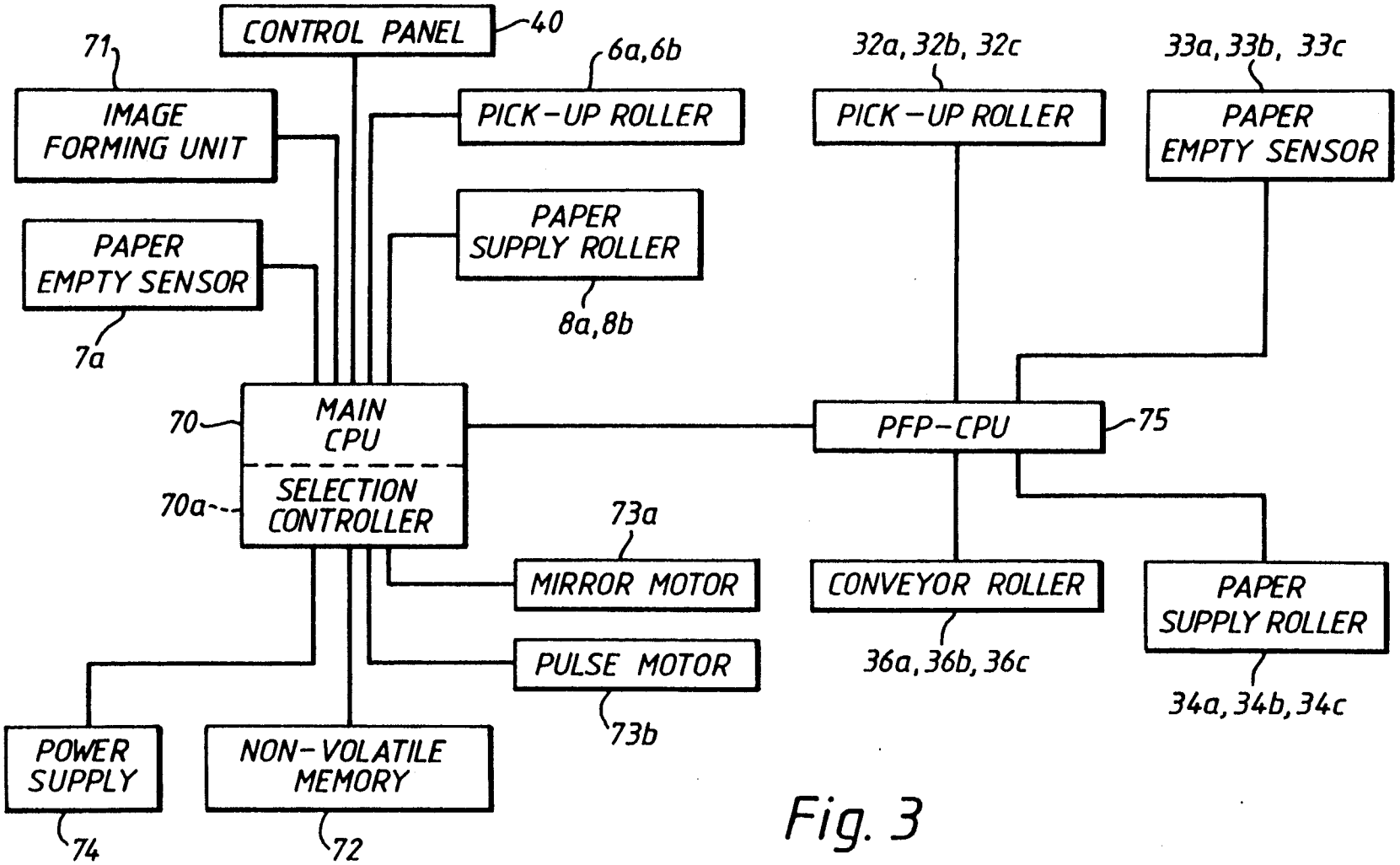
FIG. 3 is a block diagram showing the control system of the copying machine of the first embodiment according to the present invention.
Figure 4:
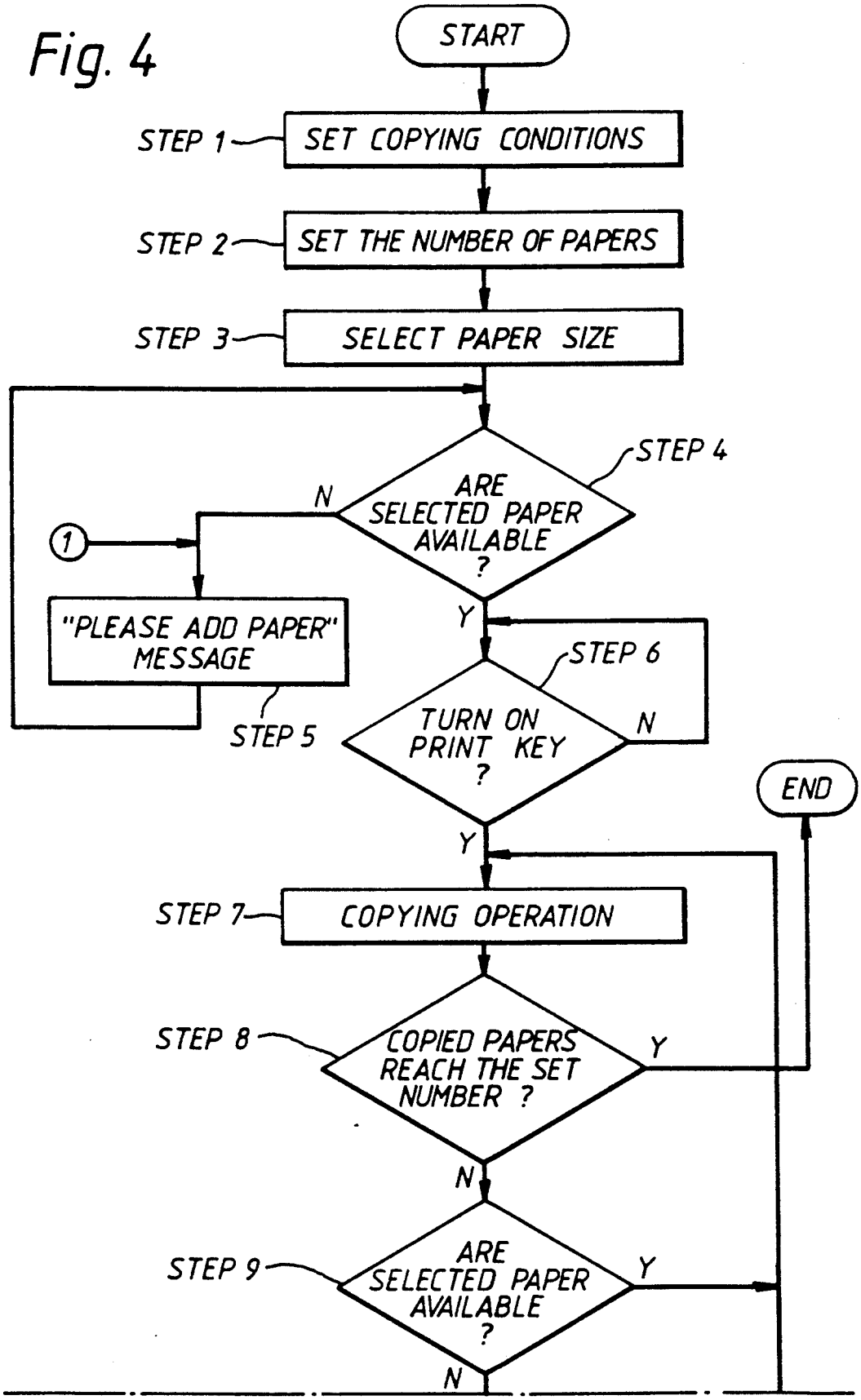
FIG. 4 flow showing the image forming process executed in the copying machine of the first embodiment according to the present invention.
Figure 4:
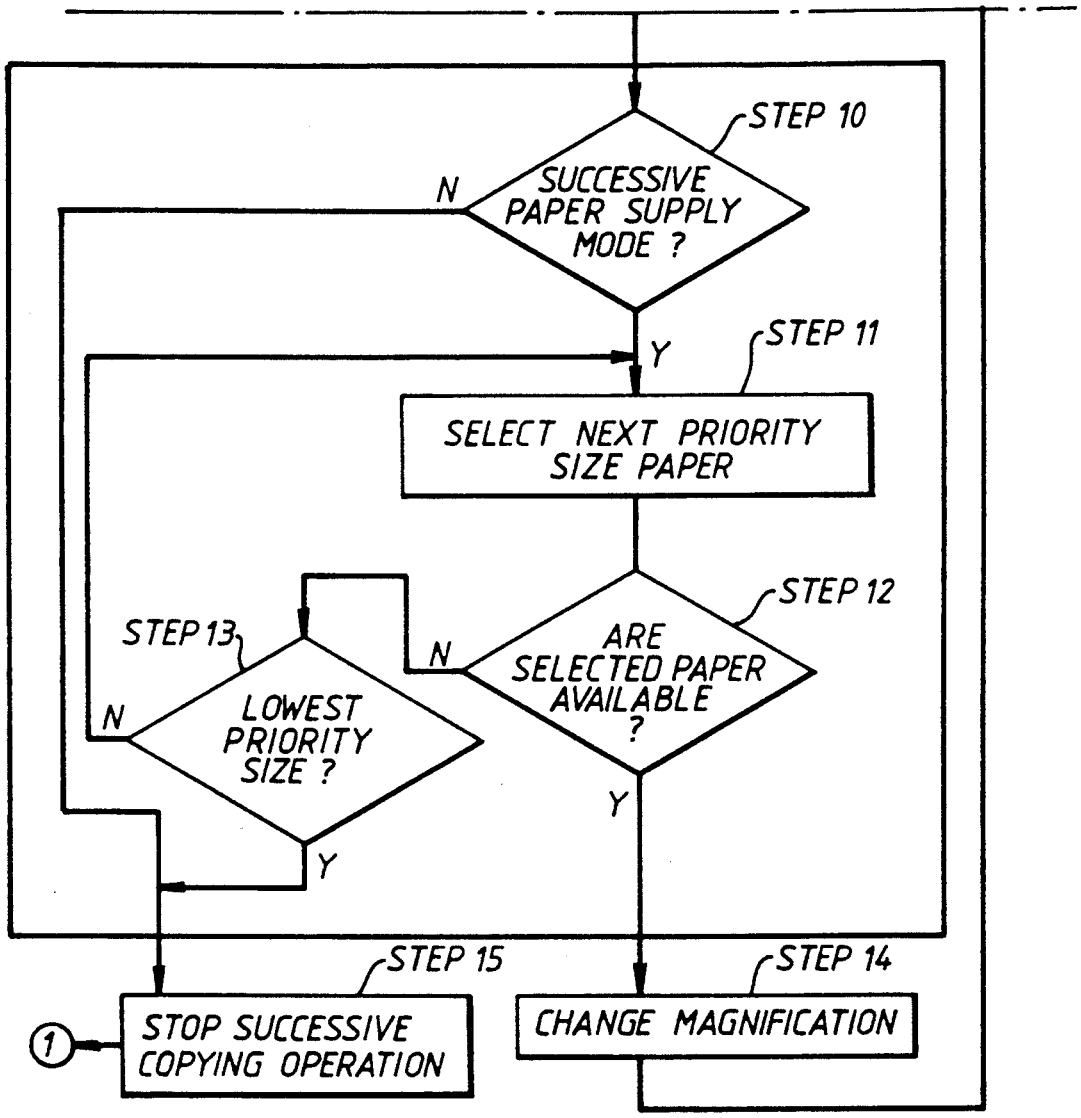

FIG. 3 shows a block diagram of the control device of the copying machine I of this embodiment. The mirror motor 73*a* which is a magnification changing means and moves the mirror and the pulse motor 73*b* which reciprocates the first and second carriages 10 and 20 are connected to a main CPU 70 which is a main control unit and includes a selection unit. Further, the image forming unit 71 consisting of the main charger 51, the developing device 52 and the transfer charger 53, and the control panel 40 as an input means are connected to the main CPU 70. Further, the pick-up rollers 6*a* and 7*b* and the paper supply rollers 8*a* and 8*b* for picking up and supplying the paper P from the manual paper supply tray 6 or the paper supply cassette 7, a power supply 74 for supplying power to each part of the copying machine 1, etc. are connected to the main CPU 70. In addition, a non-volatile memory 72 such as EEPROM is also connected to the main CPU 70. Such data as priorities relative to paper sizes are stored in the non-volatile memory 72. Priorities relative to paper sizes referred to here are data relative to priorities relative to what size of paper should be selected if papers of certain size is completely exhausted during the successive image forming operation. For each size of paper, a priority order is preset for different sizes of papers to be selected so that when papers with a given priority of size have been exhausted the other papers with a next priority will be selected. For example, for A4 size of papers the priority order is preset in the order of B5, B4, A3 and so on.

Further, a CPU 75 of PFP 30 is connected to the main CPU. To the CPU 75 at the PFP side, the pick-up roller 32, the paper empty sensor 33, paper supply roller 34 and conveyor roller 36 are connected. These items are controlled by the CPU 75 of PFP under the control of the main CPU 70.

The selection control circuit 70*a*, which is a selection means, is incorporated in the main CPU 70 and if desired paper is exhausted during the successive paper feeding, a paper supply cassette storing higher priority size papers is selected from the paper supply cassette 7 at the copying machine 1 side and the first through third paper supply cassettes 31*a*, 31*b*, 31*c* at the PFP 30 side is selected according to the priority data of the changing sequence of paper sizes set in the non-volatile memory 72 and by considering the paper empty sensor 7*a* at the copying machine 1 side and the paper empty sensors 33*a* through 33*c* at the PFP 30 side. Now the copying operation in the copying machine 1 in the construction described above will be explained. First, such copying conditions as the number of desired copies, coying magnification, paper size, etc. are set by an operator through the control panel 40. Further, when the print key 41 is depressed, the optical scanner lamp 11 lights, the first carriage 10 starts to move and thus, the image of the original document D placed on the platen glass 2 is scanned. The light reflected on the original document D is further reflected on the first mirror 13 and it led to the second mirror 21 provided on the second carriage 20. The light reflected on the second mirror 21 is further reflected on the third mirror and is led to the lens 4. Here, the lens 4 was moved by the driving unit that is not shown to a position where a desired magnification is obtained. The reflected light from the original document D, that was converted into the focusing light by the lens 4 is reflected on the fourth mirror 14 and is focused for forming an image at a fixed position on the photosensitive drum 5 to which a predetermined electric charge is given. That is, the reflected light from the original document D is slit exposed and an electrostatic latent image is formed on the photosensitive drum 5.

The electrostatic latent image formed on the photosensitive drum 5 is led to the developing region along with the movement of the photosensitive drum 5 which is rotating at a fixed speed. In the developing region, a toner is supplied to the electrostatic latent image on the photosensitive drum 5 as a developer from the developing device.

In parallel with a series of operations so far carried out, paper P in proper size is obtained from size of original document D and copying magnification and a paper supply cassette storing paper P in applicable size is selected from the paper supply cassette 7 in the main body or the paper supply cassettes 31*a*, 31*b* or 31*c* of PFP 30. Then, a paper P is taken out of the selected paper supply cassette and conveyed to the aligning rollers 9. The leading edge of the paper P aligned by the aligning rollers 9 is aligned with the leading edge of the toner image on the photosensitive drum 5 and the paper P is then conveyed to the transfer region.

The toner image formed on the photosensitive drum 5 is moved as the drum 5 is rotated at a fixed speed. When the toner image reaches the transfer region specified between the photosensitive drum 5 and the transfer charger 53, electric charge with the same polarity as that of the electric charge already given to the photosensitive drum 5 is supplied to the paper P conveyed from the aligning rollers 9 from the transfer charger 53. As a result, the toner image on the photosensitive drum 5 is transferred onto the paper P. The paper P with the toner image transferred is separated from the drum 5 when AC voltage is applied from the separation charger 53 and sent out to the conveyor belt in the condition with the toner image transferred. Then, the paper P is conveyed to the fixing device 15 by way of the conveyor belt 18 and its toner image is fixed by the fixing device 15. Then, the paper P is ejected into the receiving tray 17.

Further, after transferring the toner image on the paper P, the photosensitive drum 5 is further rotated and its surface is cleaned by the cleaning device 54. That is, the residual toner on the surface of the drum 5 is removed by the cleaning device 54 and at the same time, residual electric charge on the surface is also removed by a discharge lamp that is not shown. Now, the photosensitive drum 5 is placed in the state ready to next transfer operation.

Here, if the successive copying operation is set by an operator, the copying process is repeatedly carried out until the copying operation in the set number of times is completed. However, there may be a case where papers stored in a selected paper supply cassette is exhausted before completing the successive copying operation in the set number of times. The flow of control in this case is explained below referring to the flowchart shown in FIG. 4.

First, copying conditions such as magnification, image density, requirement of edge erase, etc. are set by an operator through the control panel 40 (STEP 1). Then, the number of papers to be copied is set by the ten keys 42 on the control panel 40 (STEP 2). Next, size of paper to be used in the copying operation is selected (STEP 3). The paper size selection may be direct a selection of a paper supply cassette storing desired size paper by operator himself through the paper size selection key 43 on the control panel 40 or CPU 70 may select a paper supply cassette storing papers in the size that is determined to be proper by CPU 70 from original document size sensed by an original document size detector that is not shown. Then, it is determined if a paper supply cassette storing papers in the size selected in STEP 3 is available and further, if papers are available in the paper supply cassette referring to the outputs from the paper empty sensors 7*a*, 33*a*, 33*b* and 33*c* (STEP 4). If papers are exhausted in the paper supply cassette selected in STEP 4, a message "PLEASE ADD PAPER" is displayed on the LCD 45 on the control panel 40 and the machine is placed in the standby state until papers are fed therein (STEP 5).

If papers in the size selected in STEP 4 are confirmed available, referring to the output from the print key 41 it is determined whether the print key 41 is turned ON, that is, whether start of the copying is directed (STEP 6). When the print key 41 is turned ON, an original document image is formed on a paper by the operation described above (STEP 7). Then, it is determined if the number of papers copied reaches the number of copies set in STEP 2 (STEP 8). If the number of copies set in STEP 2 does not reach, it is determined if papers are available in the paper supply cassette (STEP 9). Until paper in the paper supply cassette is exhausted or the number of copies set in STEP 2 reaches, the copying operation in STEP 7 is repeatedly carried out and all processes are terminated at the point of time when it is determined if the copying of the set number of papers is completed in STEP 8.

Now, if it is determined if the papers are exhausted in a paper supply cassette storing selected size paper in STEP 9, referring to the output from the mode changeover key 44 on the control panel 40, it is determined if the copying machine 1 is in the successive paper supply mode (STEP 10). If not, suspending the successive copying operation (STEP 15), it returns to the process in STEP 5 and displaying the message "PLEASE ADD PAPER" on the LCD 45, the machine is placed in the standby state until papers are fed therein.

When the copying machine is determined as being in the successive paper supply mode in STEP 10, referring to the data stored in the non-volatile memory 72 relative to priority of paper size, papers in the size, having lower priority selected in STEP 3 (that is the highest priority stored in the non-volatile memory), is selected (STEP 11). Then, it is determined if a paper supply cassette storing the selected size papers is available and further if the paper supply cassette stores papers (STEP 12). If the selected size of papers is not available, the judgment is made if the currently selected size is the lowest priority size (STEP 13) and if not, the operation returns to STEP 11 to judge if papers in the lower priority size than the currently selected size are available. Thus, STEP 11 through STEP 13 are repeatedly carried out. If the paper size selected in STEP 13 is determined as being the lowest priority size, the successive copying operation is suspended (STEP 15) and the operation returns to STEP 5 and displaying the message "PLEASE ADD PAPER" on the LCD 45, the operations from STEP 4 are repeated. If it is determined that the paper of selected size is available in STEP 12, after changing a copying magnification of an original document image to fit the selected size by moving the lens 4 (STEP 14), the operation returns to STEP 7 and the copying operation is repeated successively.

As described above in detail, if papers in the size selected in the initial setting are exhausted during the successive copying operation, the copying machine I of this embodiment is capable of successively performing the copying operation by selecting another size paper according to preset priority. That is, once the conditions for successive copying operation are set, it is possible to get the desired number of copies without stopping the operation during the copying operation. Further, as the successive copying mode and the normal mode can be changed over easily on the control panel 40, if the same size-copies must be obtained, it is possible to suspend the successive copying operation once as usual when papers are exhausted and to resume the copying operation after feeding papers.

Figure 5:
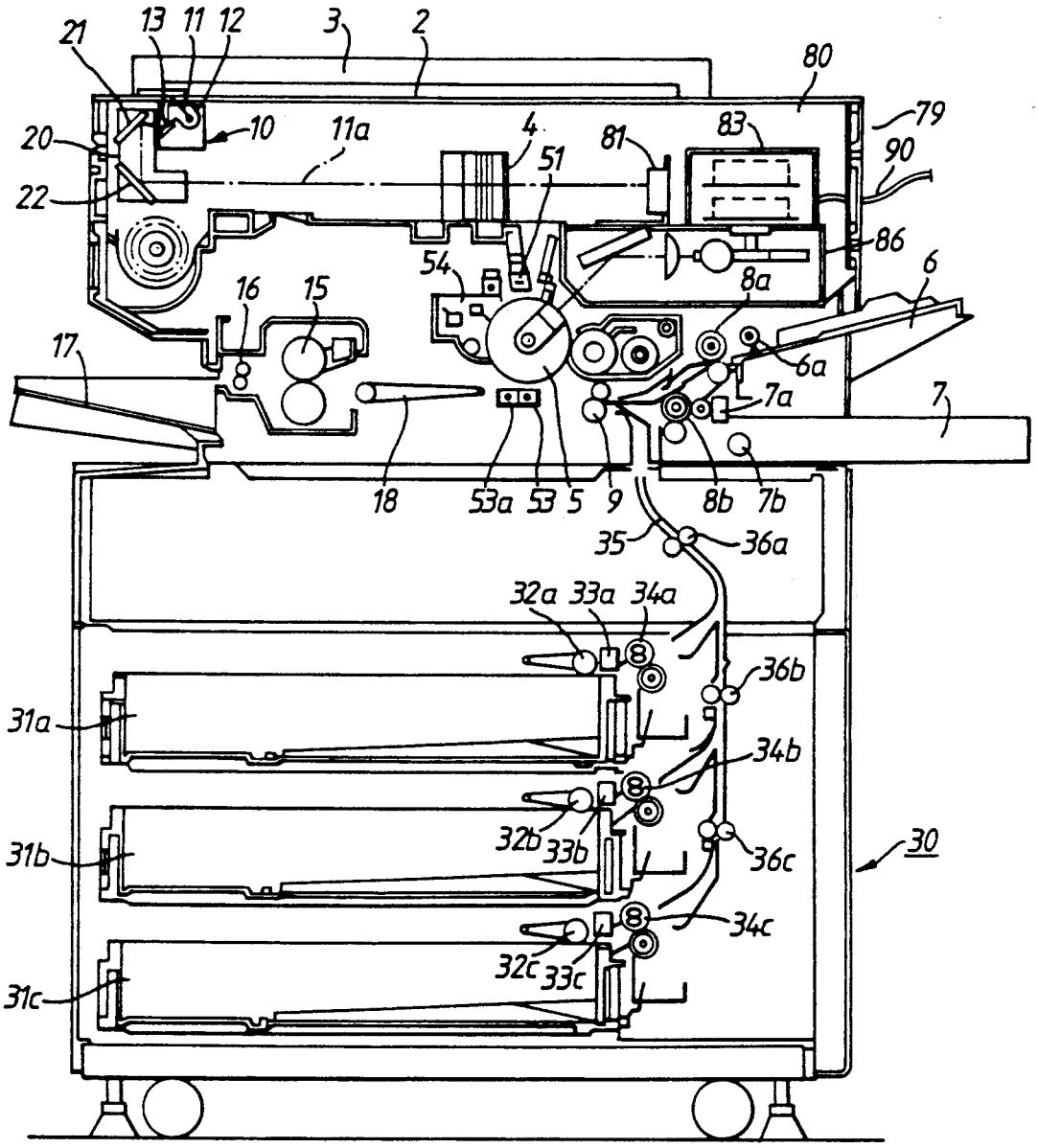
FIG. 5 is a schematic cross-sectional view showing a copying machine of the second embodiment according to the present invention.
Figure 6:
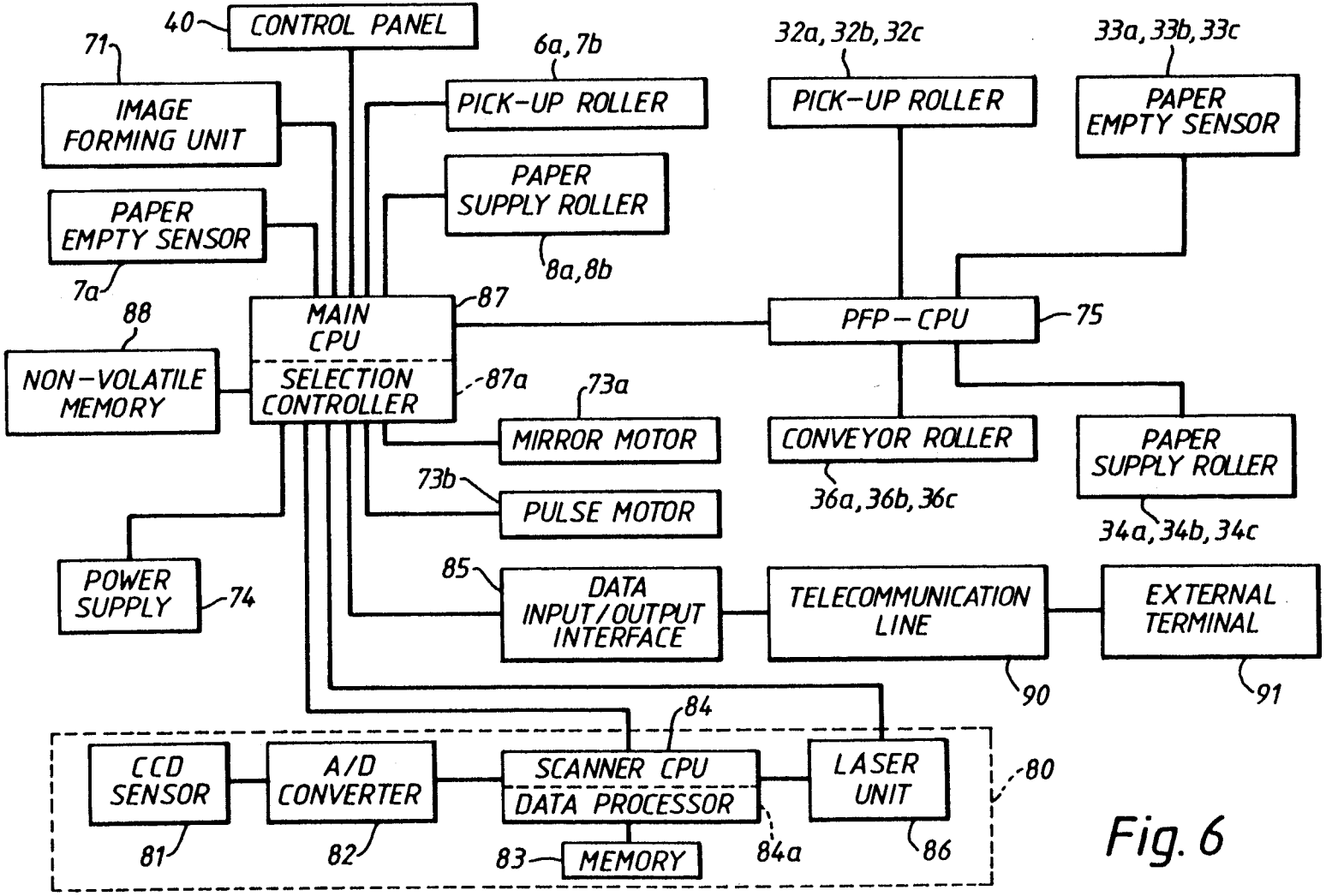
FIG. 6 is a block diagram showing the control system of the copying machine of the second embodiment according to the present invention.
Figure 7:
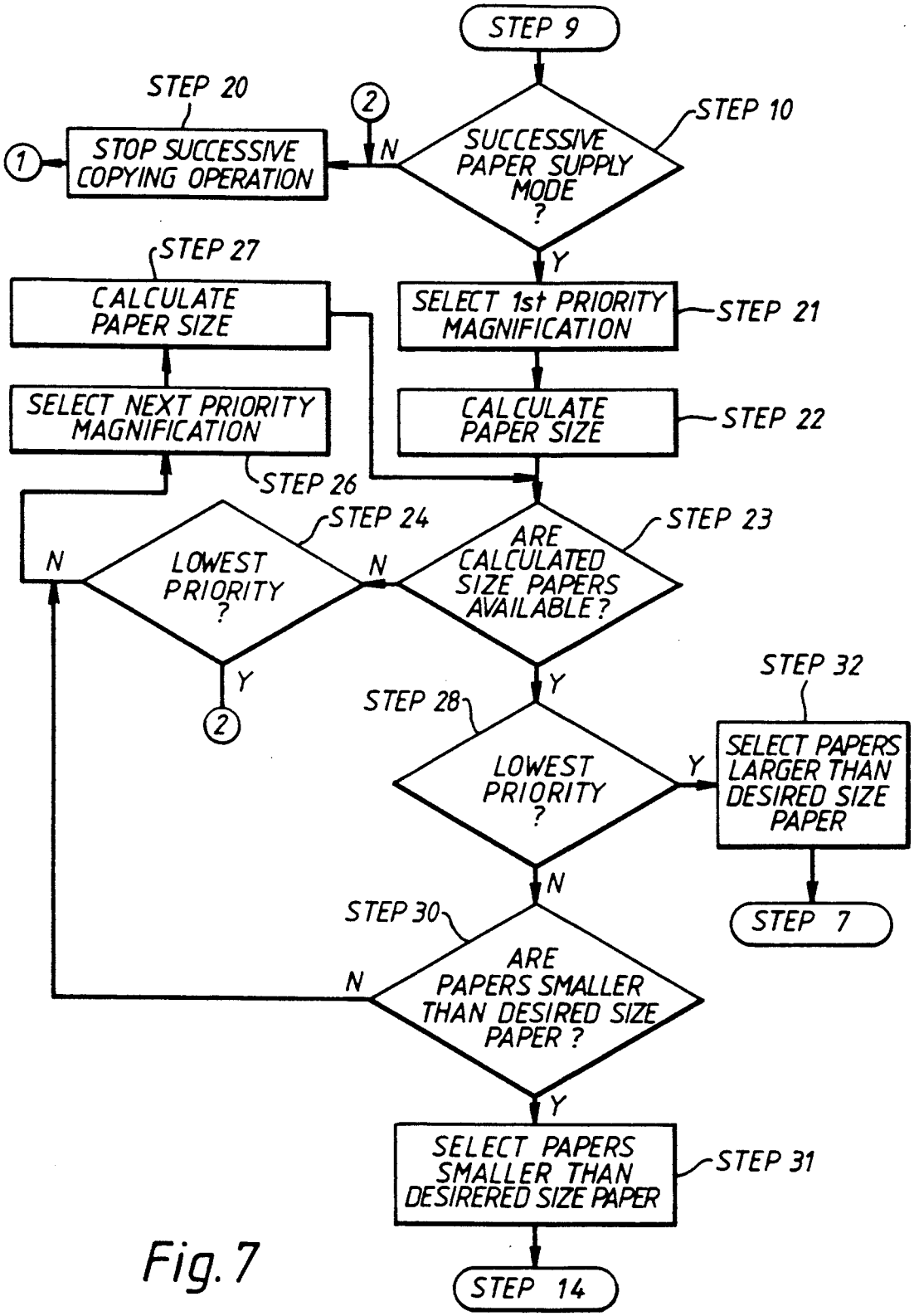
FIG. 7 is a flow showing the image forming process executed in the copying machine of the second embodiment according to the present invention.

Referring now to FIGS. 5 through 7, the second embodiment of the present invention will be explained.

Although in the first embodiment the reflected light is directly applied on the photosensitive drum 5, in this second embodiment such a light reflected from an original document D, which is generated by an exposure device, is converted to a digital image data signal through an image data processing device. Alternatively, an image data signal supplied from external image collection device could be applied to the photosensitive drum 5, after converted into an image light by a laser unit.

Further, in the first embodiment when desired size papers are exhausted during a successive copying operation, other papers stored in any one of a plurality of other paper storages loaded on the copying machine 1 are supplied in a selected sequence according to a preset priority sequence, and then a copying magnification of an original document image is changed to fit the newly selected size paper. While in the second embodiment a priority sequence is preset on a copying magnification of an original document image for selection of papers to be used following an exhaustion of a stock of desired size papers during a successive copying operation. Then the copying magnification is successively established in accordance the preset priority sequence, and then papers available for forming the image with the selected copying magnification are selected from any one of a plurality of other paper storages loaded on the copying machine 1, so that the successive copying operation is succeeded in the priority sequence of copying magnification of image.

Thus, portions the same or equivalent to those of the first embodiment other than the differences described above are assigned with the same reference numerals, but will be omitted in the following explanation of the second embodiment for simplicity of explanation.

In the second embodiment a complex image forming section 79 comprises an image data processing apparatus 80 for executing an image data processing on a light focused thereon though a lens 4, which is generated from an exposure lamp 11 and reflected by an original document D. That is, a CCD sensor 81 is located at the focusing position of the light through the lens 4 for converting the reflected light into an analog signal. The CCD sensor 81 is coupled to an A/D converter 82 for converting the analog signal to a digital signal under a control of a scanner CPU 84 coupled to a main body CPU 87. The scanner CPU 84 is coupled to a memory 83, as well as comprising therein a data processor **84*a*** for executing a plurality of data processings such as a brightness control, a copying magnification control, an editing operation, etc.

On the other hand, the main body CPU 87 is adapted for receiving image data from an external terminal 91 such as a facsimile machine, coupled to a data input/output interface 85 via a telecommunication line 90.

Further the image data processing apparatus 80 is provided with a laser unit 86 which operates to convert the image data signal processed by the scanner CPU 84 to a laser beam for applying the laser beam on the photosensitive drum 5 thus forming a latent image on the photosensitive drum 5.

The main body CPU 87 is also coupled to a non-volatile memory 88 which stores data of copying magnifications for use in execution of image forming operation on successor papers following the an exhaustion of desired size papers during a successive copying operation mode.

The data regarding the copying magnification during successive copying operation mode herein represents data indicating a priority sequence of the copying magnification to be changed from the magnification initially used for the exhausted desired size papers. For example, to priorly select a paper size smaller than a prescribed paper size a copying magnification of 90% is assigned with the first priority and then the priority is reduced in every 10% decrease of the copying magnification until 50%, while next to the 50% magnification a lowest priority is assigned for the 100% magnification. These image magnification priority data are stored in the non-volatile memory 88.

The main body CPU 87 includes a selection controller **87*a* operating as a selector. The selection controller 87*a* calculates a paper size smaller than the size of the exhausted desired papers, which is available for image forming thereon at an image magnification selected in response to the image magnification priority preset in the non-volatile memory 88. The selection controller 87*a* adapted for determining the presence of papers in response to the paper empty sensor 7*a* associated with the complex image forming apparatus 79 and the paper empty sensors 33*a* through 33*c* associated with the multi-stage paper feeding pedestal (PFP) 30, and for selecting a paper supply cassette storing papers with a size smaller than the exhausted desired papers. However, provided that the lowest priority of the 100% magnification are presently selected, the selection controller 87*a*** are allowed to select a paper supply cassette storing papers with a size larger than the size of the exhausted desired papers.

Accordingly, when the desired size papers were exhausted during the successive copy mode, the selection controller **87*a* succeeds the image forming operation for smaller size papers, by successively reducing the copying magnification in accordance with the priority data stored in the non-volatile memory 88**. On the other hand, when all smaller size papers available for the image forming at the lowest magnification were exhausted too, the 100% magnification is restored and the successive image forming operation is followed by the the larger size papers.

Referring now to the flowchart shown in FIG. 7, a flow of control in the case where the successive copy ing operation is set by an operator and papers stored in a designated paper supply cassette were exhausted before the completion of the preset times of copying operation at the successive copying will be explained below.

In FIG. 7 STEPS 1 through 9 are the same as those in the first embodiment. When in STEP 9 it is determined that papers were exhausted from a presently designated paper supply cassette storing the desired size papers the flow advances to STEP 10. If in STEP 10 the successive paper supply mode is not determined, the successive copying operation is suspended (STEP 20) and the flow returns to the process in STEP 5 of the first embodiment and displaying the message "PLEASE ADD PAPER" on the LCD 45, the machine is placed in the standby state until papers are fed in the cassette.

When in STEP 10 it is determined that the successive paper supply mode is set in the complex image forming apparatus 79, firstly an image magnification with the first priority stored in the non-volatile memory 88 is selected (STEP 21). Then a paper size available for image forming thereon at the selected image magnification is calculated (STEP 22). Then it is determined if a cassette for storing papers at the calculated size and also if the cassette actually stores the papers at the size (STEP 23). If papers at the size satisfying the image magnification with the first priority are not found, it is determined if the presently selected image magnification is the image magnification with the lowest priority (STEP 24). If not, an image magnification with the next priority is selected (STEP 26). Then a paper size satisfying the image magnification with the next priority is calculated (STEP 27) and the flow returns to STEP 23. When in STEP 24 the presently selected image magnification is the one with the lowest priority, the flow returns to STEP 20.

When in STEP 23 it is determined that papers at the calculated size are present, it is firstly determined if the presently selected image magnification is the one with the lowest priority (STEP 28). If not, it is further determined if papers smaller than the desired size papers initially designated at the start of the image forming operation are present. If such papers smaller than the desired papers are present, a cassette storing such papers smaller than the desired papers is selected (STEP 31) and the the flow returns to STEP 14 of the first embodiment. In STEP 14 the lens 4 is moved by the mirror motor 73*a* for establishing the selected image magnification and the flow then returns to STEP 7 wherein the copying operation for the papers at the size smaller than the desired size papers is repeated successively.

When in STEP 30 the papers at the size smaller than the desired size papers are not present, the flow returns to STEP 26 wherein an image magnification with the still next priority is selected and papers satisfying the presently selected image magnification are searched.

When in STEP 28 it is determined that the presently selected image magnification is the one with the lowest priority, a paper supply cassette storing papers larger than those as positively determined in STEP 23 is selected (STEP 32). Since the 100% magnification is selected herein, the flow advances to STEP 7 passing through STEP 14 without moving the lens 4. Thus in STEP 7 the copying operation for the papers at the size larger than the desired size papers is repeated successively.

The operations are explained for the case of succeeding the image forming operation in such successive paper supply mode at the successive copy operation. However in a case that image data is taken into the scanner CPU 84 via the telecommunication line 90, the successive paper supply mode is automatically established without manual operations for the mode selection key 44. Thus when prescribed size papers are exhausted during an image forming operation, operations of the image magnification and the paper selection on and after STEP 9 are performed.

As described above, the second embodiment can complete the successive copying operation by selecting an image magnification in accordance with a preset priority sequence and also by selecting papers with a size satisfying the selected image magnification, if desired size papers as initially set are exhausted during a successive image forming operation for image data from the image data processing apparatus 80 or the telecommunication line 90. That is, once a successive copy operation has been set, it is secured to obtain a desired number of copies without interruption of the copying operation. Thus if prescribed size papers are exhausted during an image forming operation for image data incoming over the telecommunication line 90, the image forming operation can be successively executed on other papers. Thus a fear of interruption for receiving image data caused by exhaustion of papers in night etc. can be advantageously avoided.

It is intended that the present invention not be limited to the particular embodiments as disclosed above, but that the present invention can be for many modifications without changing the spirit of the present invention. For example, in the first embodiment it is explained that the priority at the sequence of B5, B4, A3 for succeeding the desired size of A4 has been preset. However, the priority sequence is not limited to the particular one. If a priority at a sequence of A4, B4, B5 for succeeding the desired size of A4 has been preset under a condition that another stock of A4 size papers is stored in an additional paper supply cassette loaded on the copying machine 1, the successive copying operation can be succeeded for the same A4 size papers in the paper supply cassette after the exhaustion of the A4 size papers in the initially designated paper supply cassette.

In the first embodiment when a change of paper size is made in the successive paper supply mode, the copy operation is executed after the image magnification is changed to fit the newly selected paper size. However the copy operation can be made on the newly selected size papers as it is without changing the image magnification. Further it is also possible to provide a mode for automatically setting an image magnification in response to the selected paper size, so that an operator is allowed to voluntarily select the mode of automatically setting the image magnification. Still further the same effect can be obtained by establishing the priority on the sequence of paper supply cassettes in place of the sequence of the paper sizes.

Also in the second embodiment the image magnifications to be set and their priority sequence can be voluntarily defined, or the 100% magnification can take the first priority.

The image forming apparatus can be provided for an exclusive use of forming images for image data incoming via a data communication such as a facsimile.

As explained in detail in the, according to the present invention it is possible to provide an image forming apparatus which is capable of performing the image forming process on the desired number of papers without stopping the successive image forming operation even if fixed size paper is exhausted in a paper supply cassette during the successive image forming operation. The present invention can also provide an image forming apparatus which is capable of succeeding the image forming process in data communication without interrupting the receiving operation of the data.

While there have been illustrated and described what are at present considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation or material to the teaching of the present invention without departing from the central scope thereof. Therefore, it is intended that the present invention not be limited to the particular embodiment disclosed as the best mode contemplated for carrying out the present invention, but that the present invention include all embodiments falling within the scope of the appended claims.

What is claimed is:

1. Image forming apparatus, comprising:
means for forming an image based on image information on a paper;
means for magnifying/reducing the image to be formed by the image forming means;
multiple paper supplying means for storing papers in different size and supplying the paper to the image forming means;
means for setting times of image forming operation;
means for selecting one of the multiple paper supplying means; and
means, in a case when papers of a first size, stored in a first paper supplying means, are exhausted before a completion of the times of the image forming operation set by the setting means, for controlling the selecting means to select a second paper supplying means which stores papers of a second size, for controlling the magnifying/reducing means to magnify/reduce the image in accordance with a proportion of the first size and the second size, and for controlling the image forming means to form an image, magnified/reduced by the magnifying/reducing means, on the paper of the second size.

2. Image forming apparatus according to claim 1, wherein each of the paper supplying means has its own priority in accordance with a paper size stored in itself.

3. Image forming apparatus according to claim 2, wherein the controlling means controls the selecting means to select the paper supplying means in accordance with the priority of the paper supplying means.

4. Image forming apparatus, comprising:
means for forming an image based on an image information data on a paper;
means for communicating the image forming information data through a communication line;
means for processing the image information data so as to magnify/reduce the image to be formed by the image forming means;
multiple paper supplying means for storing papers in different size and supplying the paper to the image forming means;
means for selecting one of the multiple paper supplying means; and
means, in a case when papers of a first size, stored in a first paper supplying means, are exhausted before a completion of the data communication operation by the communicating means, for controlling the selecting means to select a second paper supplying means which stores papers of a second size, for controlling %he processing means to process the image information data to magnify/reduce the image in accordance with a proportion of the first size and the second size, and for controlling the image forming means to form an image, magnified/reduced by the magnifying/reducing means, on the paper of the second size.

5. Image forming apparatus according to claim 4, wherein each of the paper supplying means has its own priority in accordance with a paper size stored in itself.

6. Image forming apparatus according to claim 5, wherein the controlling means controls the selecting means to select the paper supplying means in accordance with the priority of the paper supplying means.

7. Image forming apparatus, comprising:
means for forming an image based on image information on a paper;
means for magnifying/reducing the image to be formed by the image forming means;
means for storing a kind of magnifying/reducing ratio;
multiple paper supplying means for storing papers in different size and supplying the paper to the image forming means;
means for setting times of image forming operation;
means for selecting one of the multiple paper supplying means; and
means, in a case when papers of a first size, stored in a first paper supplying means, are exhausted before a completion of the times of the image forming operation set by the setting means, for controlling the selecting means to select a second paper supplying means which stores papers of a second size possible for forming an image magnified/reduced by the magnifying/reducing means in a predetermined ratio stored in the storing means, and for controlling the magnifying/reducing means to magnify/reduce the image in accordance with the predetermined ratio, and for controlling the image forming means to form an image, magnified/reduced by the magnifying/reducing means, on the paper of the second size.

8. Image forming apparatus according to claim 7, wherein each of the magnifying/reducing ratio stored in the storing means has its own priority.

9. Image forming apparatus according to claim 8, wherein the controlling means controls the selecting means so as to select papers of the first size possible for forming an image magnified/reduced at a first priority, and to select papers of the second size possible for forming an image magnified/reduced at a second priority, when the papers of the first size has been exhausted.

10. Image forming apparatus, comprising:

means for forming an image based on an image information data on a paper;

means for communicating the image forming information data through a communication line;

means for processing the image information data so as to magnify/reduce the image to be formed by the image forming means;

multiple paper supplying means for storing papers in different size and supplying the paper to the image forming means;

means for selecting one of the multiple paper supplying means; and means, in a case when papers of a first size, stored in a first paper supplying means, are exhausted before a completion of the data communication operation by the communicating means, for controlling the selecting means to select a second paper supplying means which stores papers of a second size possible for forming an image magnified/reduced by the magnifying/reducing means in a predetermined ratio stored in the storing means, and for controlling the magnifying/reducing means to magnify/reduce the image in accordance with the predetermined ratio, and for controlling the image forming means to form an image, magnified/reduced by the magnifying/reducing means, on the paper of the second size.

11. Image forming apparatus according to claim 10, wherein the controlling means controls the selecting means so as to select papers of the first size possible for forming an image magnified/reduced at a first priority, and to select papers of the second size possible for forming an image magnified/reduced at a second priority, when the papers of the first size has been exhausted.

* * * * *